US006253399B1

(12) United States Patent
Wagner

(10) Patent No.: US 6,253,399 B1
(45) Date of Patent: Jul. 3, 2001

(54) TRAY CADDY

(76) Inventor: William J. Wagner, Freedom, Ltd., P.O. Box 96401, Las Vegas, NV (US) 89193-6401

( * ) Notice: Subject to any disclaimer, the term of this patent is extended or adjusted under 35 U.S.C. 154(b) by 0 days.

(21) Appl. No.: 09/071,761

(22) Filed: May 1, 1998

Related U.S. Application Data

(60) Provisional application No. 60/045,479, filed on May 2, 1997.

(51) Int. Cl.[7] ..... A47B 23/02

(52) U.S. Cl. ..... 5/507.1; 5/503.1; 5/658; 248/340; 108/49

(58) Field of Search ..... 5/507.1, 658, 503.1; 108/49; 248/339, 340, 214

(56) References Cited

U.S. PATENT DOCUMENTS 3,276,045 * 10/1966 Bement ..... 108/49
3,400,829 * 9/1968 Youngson ..... 5/507.1 X
4,357,881 * 11/1982 DeLong ..... 108/49
4,504,992 * 3/1985 Herron et al. ..... 5/507.1 X
5,359,741 * 11/1994 Lang ..... 5/507.1
5,472,164 * 12/1995 Contee, Jr. ..... 248/214
5,758,374 * 6/1998 Ronci ..... 5/507.1
5,803,422 * 9/1998 Buehler ..... 248/339

* cited by examiner

*Primary Examiner*—Michael F. Trettel
*Assistant Examiner*—James M Hewitt
(74) *Attorney, Agent, or Firm*—Kenehan & Lambertsen, Ltd.; John C. Lambertsen

(57) ABSTRACT

A tray may be temporarily attached to a supporting frame, such as a bed frame rail, to provide a support surface that enables the placement of various desired personal accessories in close proximity to persons enjoying limited mobility. A side support member is attached to an edge of the tray, and extends perpendicularly above and below the support surface of the tray. The upper portion of the side support is formed into a retaining hook, of a size permitting it to be received upon a circular bed support railing. The lower portion of the side support rests against a lower support railing. In this manner the lower side support resists the tendency of the retaining hook to rotate about the upper bed frame railing as accessories are placed upon the outwardly-extending support surface.

11 Claims, 2 Drawing Sheets

TRAY CADDY

CROSS-REFERENCE TO RELATED APPLICATION

This application claims the benefit of U.S. Provisional Application No. 60/045,479, filed May 2, 1997.

BACKGROUND OF THE INVENTION

1. Field of the Invention

The present invention relates to portable support surfaces and, more particularly, to such support surfaces as can be selectively attached to various supporting structures. More specifically, the present invention relates to a support surface that is configured to be selectively attachable to circular railings of the type used to form the outer framework for hospital beds.

2. Description of the Prior Art

The twentieth century has been one of profound social and demographic change. Throughout the world, infant and young child mortality has decreased, birth rates have fallen, and life expectancy has significantly increased. There now is a need to provide these longer-lived people with the required psycho-social space to permit them to continue their contribution to and enjoyment of society.

In the world today, some thirty-one countries each have over two million citizens aged 60 and over. Projections now indicate that by the year 2025, upwards of 1.2 billion people will be in this age group—over twice as many as in 1990.

This "graying" of society has been most noticeable in the richer, more economically developed countries. In Europe, for example, approximately 20 percent of the population is now aged over 60. This trend towards "older" societies continues to spread as a result of improved social and economic conditions. By the year 2025, people aged 60 and over in Japan and Singapore could constitute 29% and 27% of those country's populations, respectively. In Sweden, where over 20% of the population is already over age 60, by 2025 it is projected to have increased to a 30% level.

No social and demographic change of this magnitude can occur without, at the same time, provoking new demands and new challenges on society. The coming years will test the capacity of society and its institutions to respond meaningfully to the broad health and social needs of older people. Compounding this "aging" phenomenon is a parallel evolution of the family during this century. Having become smaller, more mobile, and much more independent than extended family networks in the past, the contemporary family has become less able or prepared to care for older relatives.

In addition to familial concerns, the changing face of employment as the next century approaches has brought another set of problems. The elderly are faced with the growing contradiction of being more physically fit for longer than before, but at the same time being confronted with longer years of economic inactivity. There also has been a change in social attitudes toward the elderly. Now seen as being healthier (which for the most part may be true for many elderly), as well as being more mobile and economically independent, the elderly are also thought to be more psychologically able to cope with themselves than previously was believed.

No matter how healthy or autonomous older people appear to be, the fact remains that age brings with it the heightened risk of a variety of degenerate diseases and psycho-social concerns. Cardiovascular disease, diabetes, osteoporosis, difficulties in hearing and vision, as well as Parkinson and Alzheimer diseases and dementia are all more common in the later years.

While many of these problems are now becoming treatable, they show few signs of being curable. Instead, they are becoming the chronic diseases of modern society, often difficult to manage socially, and ever more costly to manage medically. Additionally, the psycho-social needs of the elderly become more pronounced with age. The need for companionship, the need to feel wanted, and the need for social and emotional support are central themes in the everyday lives of older people.

With hospital stays running at from $800 to $1,400 per day, on average, long term health care for the elderly at hospitals is not an affordable option. Nursing homes have considerably lower fixed costs, $10 per bed instead of approximately $100 per bed for hospitals, and thus nursing homes have become the care facility used for long term elder care. Unfortunately, one way that nursing homes keep the per bed cost low is to minimize staff sizes, which in turn decreases the amount of time the staff can spend on individual patient/resident care.

Nursing home costs are also kept low by minimizing the amount of space allocated to each resident. With many residents suffering impairments that limit their mobility, it becomes increasingly important to locate the paraphernalia of daily life, such as telephones, remote control units, books, glasses, etc., within easy reach of the resident. In many instances, nursing homes are able to provide very little in the way of furnishings besides a bed and adjacent small table area. Surface or counter areas immediately adjacent the bed are at a premium. A need exists for inexpensively providing additional surface area to enable placement of these personal articles within easy reach of the bed-ridden resident.

SUMMARY OF THE INVENTION

It is an object of the present invention to provide a supporting surface that can be placed in close proximity to persons of impaired mobility and limited reach. For such accessories as a telephone, remote control units (for television, videotape players and the like), notepads, and facial tissues, the supporting surface of the present invention provides a storage location that is within easy reach of the user.

A rigid support tray is attached to a side support that perpendicularly extends downward from the support tray. The tray is preferably provided with an up-raised retaining edge about its circumference, reducing the risk of an object being inadvertently pushed from the tray as well as tending to contain any liquid spillages. The side support has an upper portion that is formed into an appropriate shape for a selective attachment to an independent supporting structure, which is preferably a piece of equipment or an article of furniture that is normally present.

As a common example, persons of limited mobility are frequently confined to bed. Institutional bedding is typically provided with metal supporting rails. In such instances, the upper portion of the side support is curved in a manner forming an attachment hook of an appropriate dimension to be received by the railing.

The lower portion of the side support preferably extends a sufficient extent to rest against the surface of an independently supported object, and thereby provide rotational stability and support to the support tray. For example, when the upper side support is adapted for attachment to the railing of a bed, the lower portion preferably extends a sufficient amount to permit a lower surface thereof to rest against a lower rail support for the bed. In this manner, upon loading the surface tray, the tendency of the tray to rotate about its side attachment to the bed rail is resisted by the lower portion of the side support.

Some further objects and advantages of the present invention shall become apparent from the ensuing description and as illustrated in the accompanying drawings.

DESCRIPTION OF THE PREFERRED EMBODIMENTS

Figure 1:
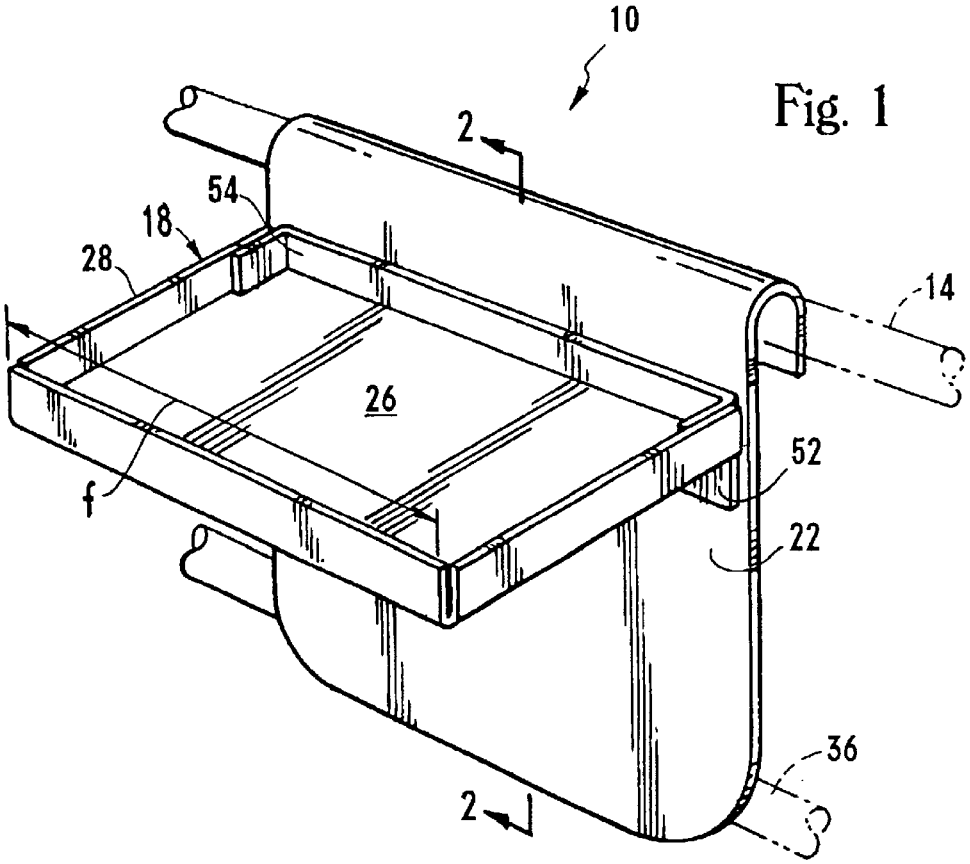
FIG. 1 is a perspective view, with portions in phantom, showing a portable tray in accordance with the present invention.

Reference is now made to the drawings wherein like numerals refer to like parts throughout. A portable support tray 10 is shown in FIG. 1, as attached to a side rail 14 (shown in phantom) of the type that frequently surround beds used in health care and nursing home facilities (not shown in FIG. 1). The portable support tray 10 preferably consists of a tray 18 that is attached to and perpendicularly projects from a lateral or side support 22.

The tray 18 is provided with a continuous support surface 26 that is peripherally surrounded by an upraised retaining edge 28. Whether continuous, or with breaks such as those shown in the corner areas in the Figures, the retaining edge 28 provides a degree of security to objects placed upon the support surface 26. The retaining edge 28 is preferably upraised a sufficient height to substantially impair the ability of objects to inadvertently slide off the support surface 26, falling from the support tray 10, yet not so high as to impair direct access by the person lying in the bed to which the portable tray 10 is removably attached. Of course, where it is desired to prevent leakage as a result of liquid spills occurring within the tray 18, the retaining edge 28 is preferably continuous about the entire circumference of the support surface 26 or a tray liner (not shown) is placed upon the support surface 26.

Figure 2:
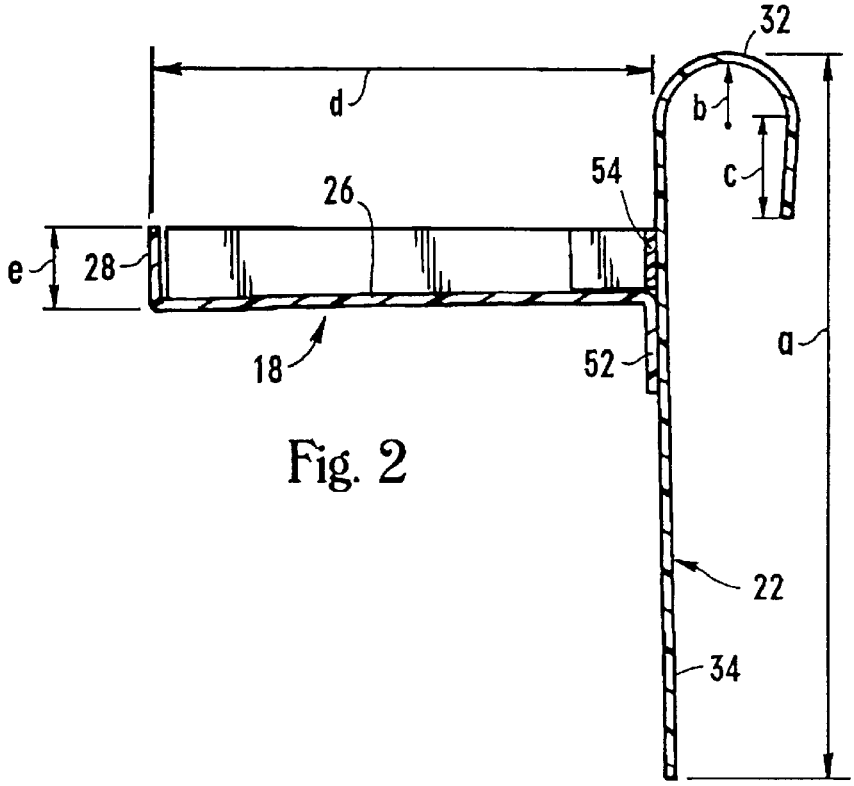
FIG. 2 is a cross-sectional view, taken along 2—2 in FIG. 1, showing the manner of tray attachment to the side support in accordance with the present invention.

Turning now to FIG. 2, the side support 22 vertically extends along a lateral edge of the tray 18 and has formed thereon a pair of mounting surfaces, as will be described hereinafter. An upper portion of the side support 22 is formed into an attachment hook 32 of curvilinear shape suitable for receiving a side rail 14 of standard diameter (see FIG. 1). A lower portion of the side support 22 preferably extends in a linear manner below the tray 18 a sufficient distance to rotationally stabilize the portable support tray 10 by forming a planar support surface that rests against a supporting frame member, such as a lower rail 36, as is shown in FIG. 1. The side support surface 34 provides stability against the turning forces created by placement of various objects (not shown) upon the support surface 26, each of which being laterally displaced from the support axis that is substantially co-located with the side support 22. In such a manner, the side rails provide external support to the tray 18 in positioning it relative to the bed.

Figure 3:
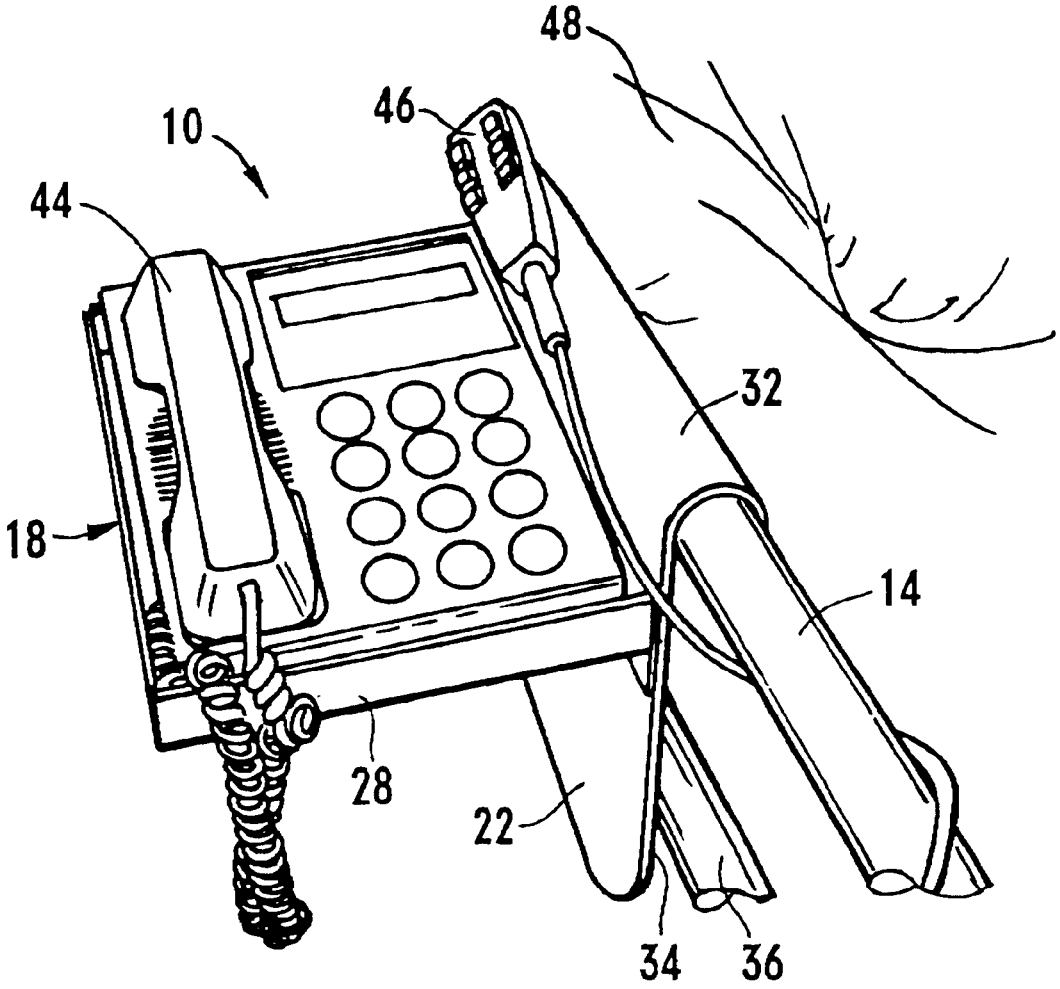
FIG. 3 is a partial perspective view showing the manner of use of a portable support tray in accordance with the present invention.

For example, turning now to FIG. 3, a telephone 44 and a bed-positioning controller 46 are shown resting upon the tray 18 of the portable support tray 10. The side support surface 34 rests against the lower rail 36 and counteracts the turning force created by the weight of the tray 18 and telephone 44 acting upon a moment arm displaced from the support axis formed by the side support 22. As is also shown in FIG. 3, the retaining edge 28 assists in maintaining the telephone 44 in its position on the support surface 26 yet permits convenient access to the telephone 44 by the person lying upon the convalescent bed 48 (no person shown in the Figures).

In a preferred embodiment, the portable support tray 10 is fabricated using heated processing steps to form the tray out of extruded sheets of ABS plastic (acrylonitrile-butadiene-styrene), of thickness 3⁄16". Returning once again to FIG. 2, the overall length a of the side support 22 is 10" with the attachment hook 32 having an inner radius b of ¾" that terminates in a linear section c of 1¼". Alternatively, for smaller (typically round) bed rails, an inner radius b of ⅝" is appropriate.

At present, the tray 18 is preferably offered in two different widths and lengths. The tray 18 preferably extends a distance d from the side support 22 of either 8" or 10". The retaining edge 28 preferably extends upward from the support surface a distance e of 1", and the support surface 26 is preferably rectangular in shape, having a length f of 10" (with width 8") or 16" (with width 10"). Attachment of the tray 18 to the side support 22 is preferably by a suitable plastic adhesive. Additionally, as is depicted in both FIGS. 1 and 2, a support bracket 52 extends from the plastic sheet that defines the support surface 26 within an extension of length 1" preferable. Likewise, a tray support bracket 54 is attached the side support 22, the support surface 26, and the retaining edge 28 to further secure the tray 18 to the side support 22.

My invention has been disclosed in terms of a preferred embodiment thereof, which provides an improved portable tray that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A supplemental support surface for use with beds having a pair of side support rails, the surface comprising:

a tray having a receiving surface formed thereon, a lateral extent of said receiving surface peripherally defined by a tray edge;

a retaining lip formed substantially continuously about a periphery of said receiving surface and projecting upwardly from adjacent portions of said receiving surface; and a lateral support attached to said tray edge, said lateral support further comprising:

a first mounting member configured as an attachment hook that extends from said tray edge and is selectively interengagable with a first external support; and a second mounting member extending from said tray in a direction substantially opposite that of said first mounting member and in a manner co-planar with said tray edge and terminating in a planar support surface that rests against a second one of the pair of side support rails when said first mounting member is interengaged with the first one of the pair of side support rails;

wherein said first mounting member and said second mounting member comprise a single sheet-form member.

2. A supplemental support surface according to claim 1, wherein said first mounting member and said second mounting member comprise a unitary lateral support member.

3. A supplemental support surface according to claim 1, wherein said first mounting member extends from said tray in a manner placing the attachment hook at a location laterally displaced from said receiving surface and elevated above a plane containing said receiving surface.

4. A supplemental support surface according to claim 3, wherein said planar support surface is formed on a lateral surface of said second mounting member, substantially adjacent a terminus thereof.

5. A supplemental support surface according to claim 4, wherein said terminus of said second mounting member is located below a plane containing said receiving surface.

6. A supplemental support surface according to claim 1, wherein said retaining lip continuously extends about a periphery of said receiving surface.

7. A supplemental support surface according to claim 6, wherein said tray and said retaining lip comprise a continuous, unitary structure.

8. A supplemental support surface according to claim 7, wherein both said lateral support and said tray are each separately fabricated out of respective sheets of a plastic material.

9. A supplemental support surface according to claim 8, wherein said lateral support and said tray comprise extruded sheets of ABS plastic.

10. A supplemental support surface according to claim 9, wherein a layer of a plastic adhesive is used to fasten together said lateral support and said tray.

11. A detachable tray for a bed frame having a pair of support railings, comprising:

a receiving area;

an upraised rim attached to and extending peripherally around said receiving area; and a side support attached to an edge of said receiving area forming a lateral retaining edge therewith, said side support having a retaining hook formed therein of a configuration conforming to an outer diameter of a first bed frame support railing, a linear extension extends from said retaining hook and terminates in a planar support surface placing said planar support surface in abutment with a second bed frame support railing when said retaining hook is received by an overlying first bed frame support railing;

wherein said retaining hook and said linear extension comprise a single sheet-form member.

* * * * *